United States Patent [19]

Deckert

[11] 4,444,033

[45] Apr. 24, 1984

[54] CYLINDER ASSEMBLIES FOR LOCK SYSTEM AND METHOD OF MANUFACTURE

[76] Inventor: Gary W. Deckert, 1512 Laurel La., Plano, Tex. 75074

[21] Appl. No.: 260,835

[22] Filed: May 5, 1981

[51] Int. Cl.[3] ..... E05B 9/04; E05B 29/04

[52] U.S. Cl. ..... 70/364 A; 70/373; 70/375

[58] Field of Search ..... 70/362, 364 R, 364 A, 70/373, 375, 379 R, 379 A, 380

[56] References Cited

U.S. PATENT DOCUMENTS 4,068,507 1/1978 Peterson ..... 70/364 A 4,162,623 7/1979 Yorio ..... 70/364 A

*Primary Examiner*—Robert L. Wolfe

*Attorney, Agent, or Firm*—Eyre, Mann, Lucas & Just

[57] ABSTRACT

A cylinder lock assembly is provided with a cylindrical plug that may be interchanged and used in different exterior body members without changing the exterior body member of the assembly. This is of advantage to eliminate the need to stock a variety of expensive cylinder assemblies for plugs having different keyways or keys with different bitting locations. It is only necessary to maintain a supply of different plugs and keys. Commonality of parts for mortise and rim type locks also reduces inventory required in commercial and institutional establishments.

The pin bores in the exterior members and the pin bores in the plugs are located a constant distance away from a selected reference point in the lock assembly and the exposed keyway face of the plugs. As a result, the pin bores in one or more plugs will align with the pin bores in one or more exterior body members so that the plugs may be used with different exterior body members. The keyways in the plugs may have different configurations and the key bittings are also varied. The reference point may be selected for convenience of manufacture.

18 Claims, 27 Drawing Figures

PRIOR ART

CYLINDER ASSEMBLIES FOR LOCK SYSTEM AND METHOD OF MANUFACTURE

BACKGROUND OF THE INVENTION

Cylinder assemblies which activate the bolt or latch of a lock are well-known and have been used in known manner in a wide variety of locking mechanisms such as mortise locks, rim locks and in key-in-knob type locks in which the cylinder assembly is mounted in the door knob. Key-in-knob type locks are commonly called cylindrical locksets which are generally mounted in a circular hole in a door. The cylinder assembly of cylindrical locksets is also used in conventional manner in patio doors, or to activate dead bolts and padlocks which do not include the entire lockset assembly.

The cylinder assembly comprises an exterior body of desired configuration and a cylindrical plug. The body and plug have aligned holes which carry spring biased slidable pins that are released by inserting a key into the plug which is thereupon free to turn some form of camming means for retracting the bolt, dead bolt, latch or padlock locking mechanism to release the type of lock at hand.

One drawback to the known assemblies is that the cylindrical plugs cannot be freely interchanged and if there is a desire to change the plug of one manufacturer for that of another, the entire cylinder assembly has to be replaced. Furthermore, it frequently happens that a cylinder assembly designed for a mortise lock cannot be used in a rim lock.

THE INVENTION

The present invention is directed to a cylinder assembly comprising an exterior body and cylindrical plug which may be interchanged and used in a different exterior body without changing the exterior body. The cylinder assembly of the present invention has the one great advantage of eliminating the need to stock a variety of expensive cylinder assemblies for plugs having different keyways or keys with different bitting locations. It is only necessary to maintain a supply of relatively inexpensive plugs and keys. Commonality of parts for mortise and rim type locks also reduces inventory which is of particular advantage in commercial and institutional establishments.

The principle of the present invention is also used to advantage in cylinder assemblies mounted in a door knob, padlock, or for activating dead bolts, patio doors, etc.

Further advantages and details of the present invention will be apparent from the description of the drawings that illustrate preferred embodiments of the invention.

Figure 3:
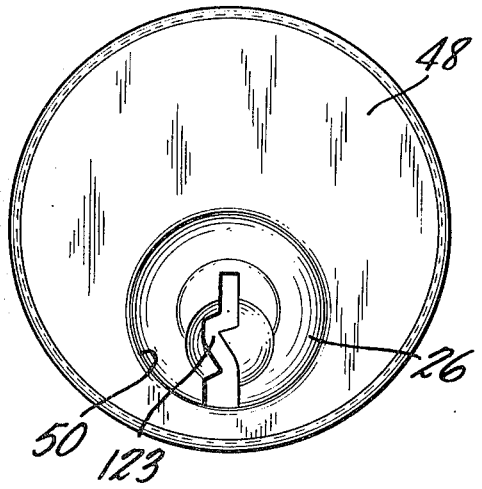
FIG. 3 illustrates the front end view of the cylinder assembly of FIG. 1 showing a typical keyway in the plug.

FIGS. 3(*a*) and (*b*) illustrate typical keyways of different configuration.

Figure 1:
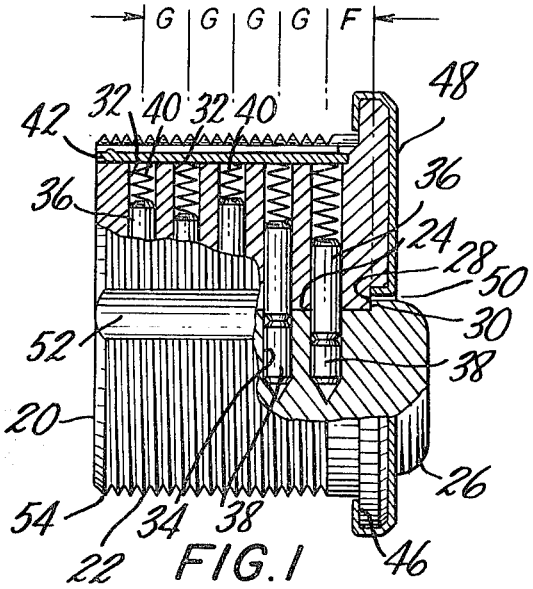
FIG. 1 illustrates a sectioned side view of the cylinder assembly of the present invention.
Figure 4:
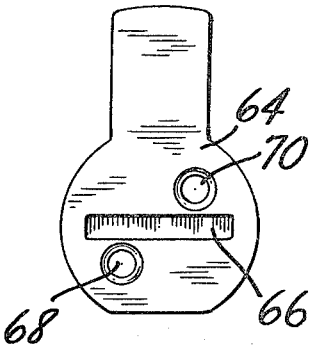

FIG. 4 illustrates a plan view of one form of cam for the cylinder assembly of FIG. 1.

Figure 5:
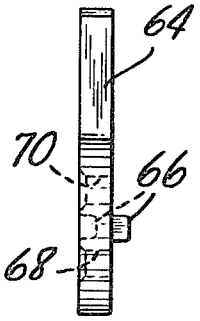

FIG. 5 illustrates a side view of the cam of FIG. 4.

Figure 6:
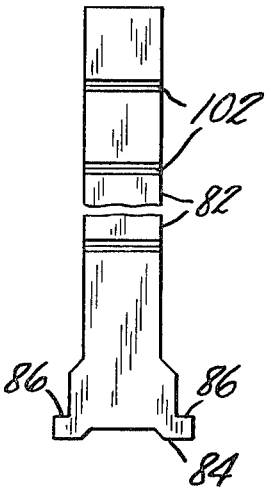

FIG. 6 illustrates a plan view of another form of cam for the cylinder assembly of FIG. 1.

Figure 7:
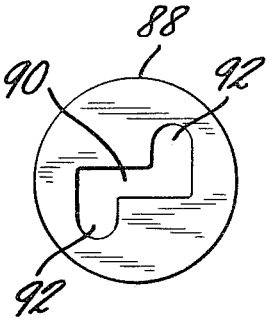

FIG. 7 illustrates a washer for the cam of FIG. 7.

Figure 8:
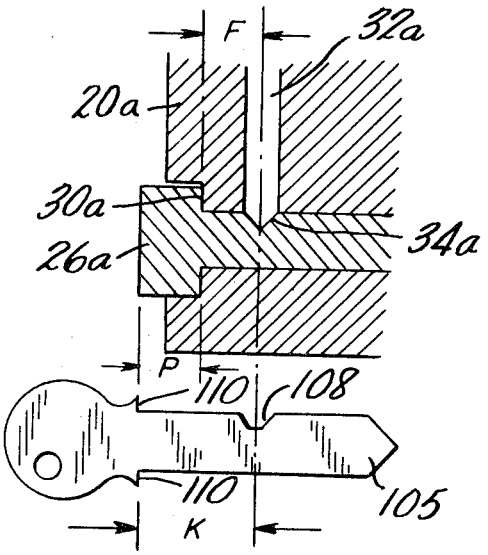
FIG. 8 PRIOR ART
Figure 9:
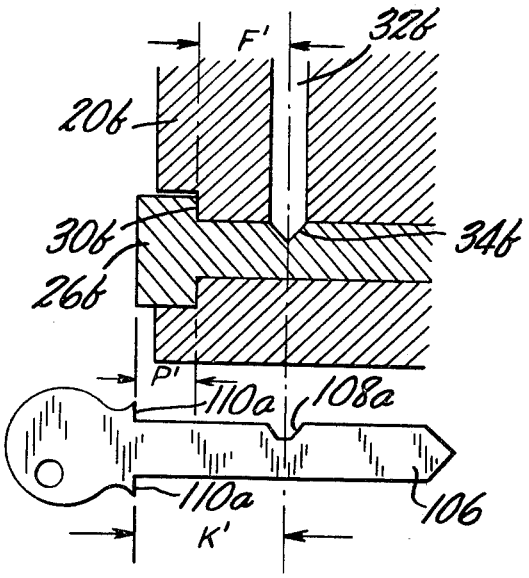

FIGS. 8 and 9 are sectional views illustrating prior art cylinder assemblies.

Figure 10:
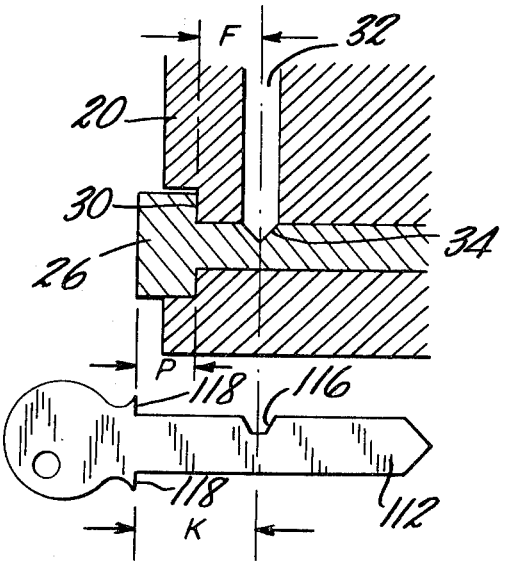
Figure 11:
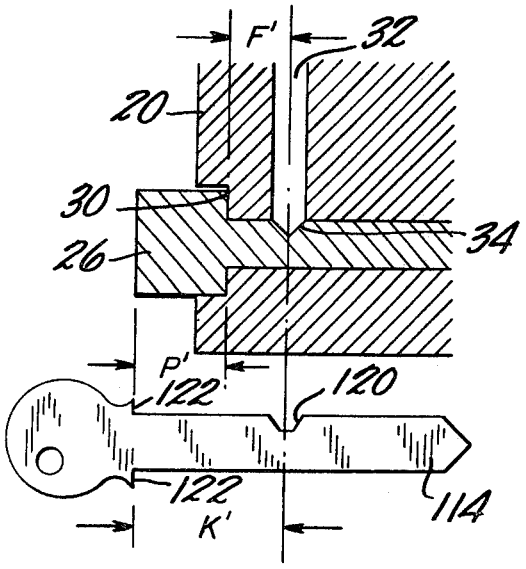
Figure 12:
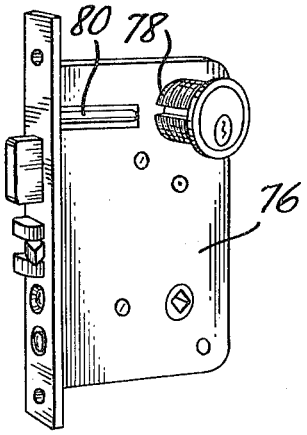

FIGS. 10 and 11 illustrate the principle of the present invention. FIG. 12 illustrates one form of a conventional mortise lock.

Figure 13:
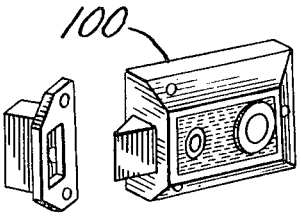

FIG. 13 illustrates one form of a conventional rim lock.

Figure 14:
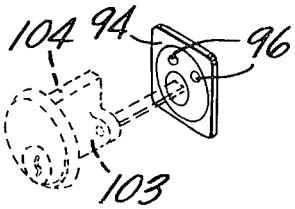

FIG. 14 illustrates the mounting of the cylinder assembly of FIG. 1 for the rim lock of FIG. 13.

Figure 15:
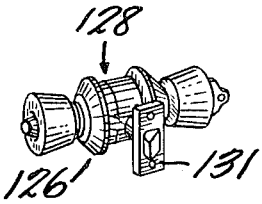

FIG. 15 illustrates one form of a conventional cylindrical lockset with the cylinder assembly of the present invention mounted in the door knob.

Figure 16:
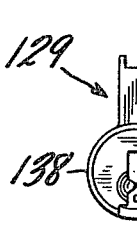
Figure 17:
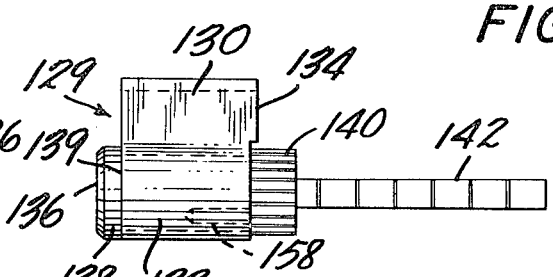

FIGS. 16 and 17 illustrate another form of exterior body for the cylinder assembly of the present invention.

Figure 18A:
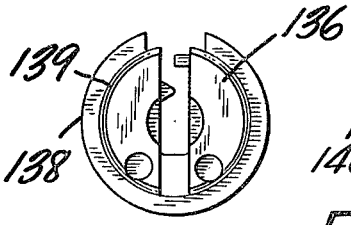
Figure 18B:
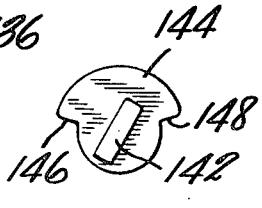
Figure 18C:
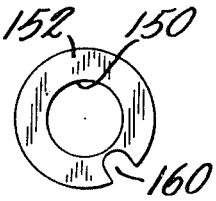
Figure 18D:
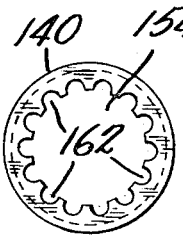
Figure 18E:
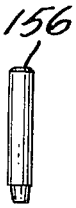
Figure 18:
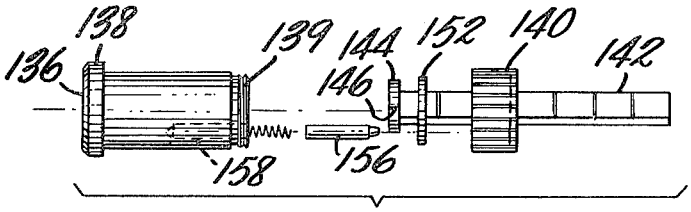

FIGS. 18 and 18 (*a*)–(*e*) illustrate a third form of cam means for the cylinder assembly of the present invention.

Figure 19:
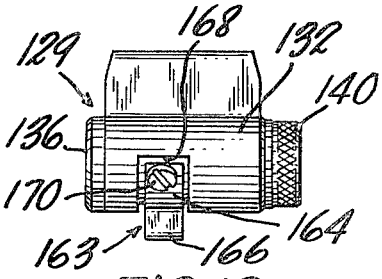

FIG. 19 illustrates a fourth form of cam means for the cylinder assembly of the present invention.

Figure 20:
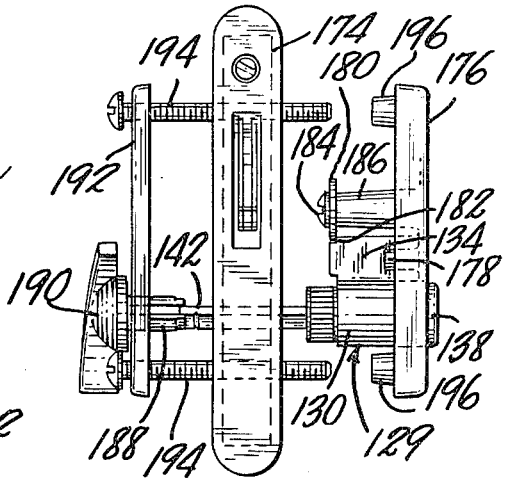

FIG. 20 illustrates one typical way in which the cylinder assembly of FIGS. 16 and 17 may be mounted in a patio door.

Figure 2:
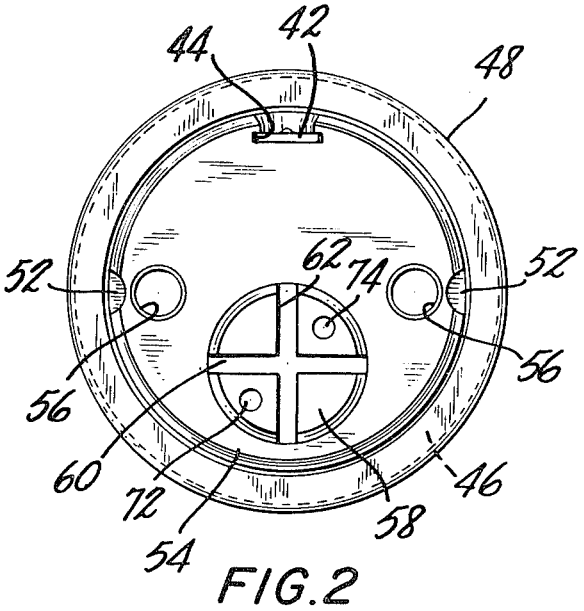
FIG. 2 illustrates the rear end view of the cylinder assembly of FIG. 1.

Turning now to FIGS. 1 and 2, the cylinder assembly of the present invention comprises an exterior body 20 in the form of a cylinder with external threads 22 and bore 24 that receives a cylindrical plug 26. The cylindrical bore 24 is stepped to provide an annular shoulder 28 that serves as a stop for annular shoulder 30 positioned on one end portion of the plug.

The exterior body and plug are provided with a plurality of pin bores 32 and 34 respectively arranged generally at a right angle to cylinder bore 24. Slidable pins 36 and 38 are respectively positioned in the bores 32 and 34 and are biased by springs 40. The pins and springs 40 are retained in bores 32 by means of a sealing strip 42 (FIG. 2) that is most conveniently crimped or otherwise secured in place in slot 44 in the exterior body in known manner as a retainer over the pin bores. The exterior body has an annular shoulder 46 at one end portion thereof and in the preferred embodiment a face plate 48 is crimped on shoulder 46 or otherwise secured to the face of the exterior body. Face plate 48 has an aperture 50 for plug 26 one end portion of which projects out through the face plate. Face plate 48 need not be used in those cases where the face of the exterior body is polished or otherwise has a finished appearance.

Opposite sides of the body 20 are provided with set screw slots 52 for mounting in a mortise lock and the second end portion 54 of the body has a pair of threaded holes 56 for mounting the body in a rim lock. The second end portion 58 of plug 26 is provided with suitable cam means for retracting a latch or bolt of a mortise or rim lock in conventional manner when the plug is rotated by means of a key. In the embodiment shown in the drawings, the cam means include cross-slots 60 and 62. Any other convenient means for affixing one or more lock activating cams to the plug may be employed in place of the cross-slots 60 and 62.

The cylinder assembly may be assembled by inserting pins 38 into pin bores 34 of plug 26 whereupon the plug is inserted through aperture 50 of the face plate and into bore 24 of body 20. The external body pins 36 and springs 40 are inserted in bores 32 and then sealing strip retainer 42 is pressed down into slot 44 and crimped or otherwise secured to cover the pin bores and retain the springs and pins therein.

If the cylinder assembly is to be mounted in a conventional mortise lock such as the one illustrated in FIG. 12, the appropriate type of mortise lock cam is affixed to the second end portion 58 of plug 26. One such mortise camming means illustrated in the drawings include cross-slots 60 and 62 and a cam plate 64 having a lock bar 66 (FIGS. 4 and 5) which is positioned on the second end portion 58 of plug 26 by inserting lock bar 66 into one of the cross slots 60 or 62. The cam plate is secured to the plug by screws (not shown) that pass through apertures 68 and 70 in the cam plate and are secured in the threaded holes 72 and 74 of the second end portion 58 of plug 26. The conventional mortise lock 76 of FIG. 12 is mounted in known manner in a door and the cylinder assembly is secured in the mortise lock by the threads 22 on the exterior of body 20 which mate with the threads in a aperture 78 provided for this purpose in the mortise lock. The cylinder assembly is locked in place by means of the mortise locking set screw 80 which is screwed in until the set screw is seated in slot 52 of body 20 in known manner with annular shoulder 46 seated against the door.

If the cylinder assembly of the present invention is to be mounted to activate a conventional rim lock such as the one illustrated in FIG. 13, appropriate cam means for a rim type lock are affixed to the second end portion 58 of plug 26. One typical rim lock cam means as shown in the drawings include cross-slots 60 and 62 and a rim lock cam or tail 82 (FIG. 6) which is frequently a flat plate having an enlarged head 84 that provides a shoulder 86 on opposite sides thereof. The enlarged head 84 is inserted into cross slot 60 or 62 of plug 26. A washer 88 (FIG. 7) is positioned to bear against the shoulder 86 with the tail 82 projecting out through slot 90 in the washer. A pair of screws (not shown) are inserted through the apertures 92 of the washer and threaded into holes 72 and 74 to anchor the rim cam tail in place on the second end 58 of plug 26. The cylinder assembly may be mounted with shoulder 46 bearing against one exposed surface of a door by means of a back plate 94 (FIG. 14) positioned against the second opposite exposed surface of the door (not shown. A pair of screws inserted through suitable apertures 96 in the back plate and through the door are received in the threaded holes 56 of body 20 and tightened to anchor shoulder 46 against the surface of the door. A suitable aperture is provided in the door to receive the body 20 and plug tail 82 which projects in through slot 98 in the back plate and into a conventional rim lock such as the rim lock 100 (FIG. 13) which is mounted over back plate 94 in known manner. In the preferred embodiment, tail 82 is serrated along its length as at 102 so that the length of the tail cam can be readily adjusted to the lock at hand.

It is to be noted that cam plate 64 and washer 88 have a greater diameter than plug 26 so that the cam plate or washer bear against the cylinder body to secure the rotatable plug in the cylinder bore.

The exterior body 103 having a generally rectangular projection 104 may also be employed in accordance with the present invention as described hereinbelow.

It will now be appreciated that the cylinder assembly of the present invention may be used for known mortise or rim type locks or dead bolts etc., it being only necessary to use the appropriate cam means on the plug for the particular lock at hand. This materially reduces manufacturing costs since a single cylinder assembly is used to activate the locking mechanism in both mortise and rim type locks and it greatly simplifies inventory and cost thereof since cam means are relatively inexpensive as compared to the cost of the cylinder assembly.

It will be understood by those of ordinary skill in the art that the cam means for mortise and rim locks shown in the drawings merely illustrate one particular form of cam means and that any of the many other conventional cam means may be affixed in known manner to the plug of the present invention to retract the latch or bolt in conventional locks. Examples of some other typical cam means are illustrated in FIGS. 18 through 20.

Another important advantage of the cylinder assembly of the present invention is that plug 26 may be used in any one of a number of exterior bodies 20 and a plug from one body can be interchanged with a plug from another body. Moreover, a different keyway may be employed in the plug without changing the exterior body and a plug adapted to be used with a particular key or keyway may be installed in any body 20.

This important feature of the present invention is best understood by reference to FIGS. 8 through 11. In conventional cylinder assemblies as illustrated in FIGS. 8 and 9, the pin bores **32*a* and 32*b* of each manufacturer are positioned in the exterior bodies 20*a* and 20*b* at varying distances away from the standard reference of shoulder 30*a* and 30*b*. And the same is true for the plug pin bores 34*a* and 34*b* which are aligned with the body pin bores 32*a* and 32*b*** respectively.

The reference point for location of bitting 108 of key 105 is the key shoulder 110 which butts against the face of plug **26*a*. As a result, the distance P plus F is equal to the distance K so that bitting 108 will be aligned with pin bore 34*a* when the key 105 is inserted in the plug with shoulder 110 against the face of the plug. The same arrangement is used on key 106 and P′ plus F′ equals K′ so that bitting 108*a* will be aligned with pin bore 34*b* when the shoulder 110*a* of key 106 is against the face of the plug 26*b*. As shown in the drawings, F is not equal to F′ and therefore K does not equal K′. It is to be noted that P is equal to P′ in FIGS. 8 and 9**.

Figure 3A:
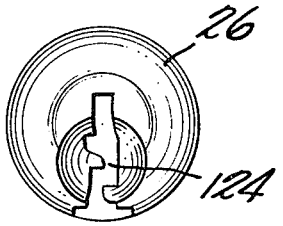
Figure 3B:
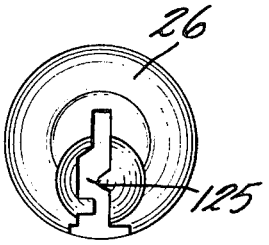

Original equipment manufacturers also use different keyways in the plugs of **20*a* and 20*b* and in general a different value K is assigned to each particular keyway. Some typical different keyway configurations are illustrated in FIGS. 3, 3*a* and 3*b***.

The distance K in the cylinder assemblies of some of the more popular manufacturers are as follows:

| Manufacturer | Distance K-inches | Manufacturer | Distance K-inches |
|---|---|---|---|
| Corbin 67 | .198 | Dexter 67 | .214 |
| Schlage C | .230 | Weiser (Falcon) | .237 |
| Schlage E | .230 | Russwin 921R | .250 |
| Segal 9 | .262 | Russwin D1 | .250 |
| Ilco-1054K | .277 | Schlage C-H | .230 |
| Sargent U | .216 | Corbin 60 | .250 |
| Sargent S | .216 | Corbin 77 | .198 |
| Weiser | .237 | Lockwood B308 | .277 |

The different "K" values include different F and F′ values as illustrated in FIGS. 8 and 9. As a result, plug **26*b* of one original equipment manufacturer cannot be used in the exterior body 20*a* of another manufacturer since the plug and body pin bores will not align and plug 26*a* cannot be used in the exterior body 20*b* for the same reason even though the keyways may be the same or different. Furthermore, it will be noted that key 105** is different from key 106. In order to change key 105 to a bitting spaced a different distance away from key shoulder 110 in the prior art cylinder assemblies, it is necessary to change the entire cylinder assembly as for example to that illustrated in FIG. 9 regardless of whether the keyway in plug 26*a* is the same or different from the keyway in plug 26*b*.

This drawback is overcome in accordance with the present invention by positioning the pin bores a constant distance F away from the reference shoulder 30 in all exterior bodies 20 so that as illustrated the distance F and F' in the bodies 20 illustrated in FIGS. 10 and 11 are exactly equal. The plugs in FIGS. 10 and 11 are therefore interchangeable and either plug works equally well in both bodies since the pin bores 34 in both plugs will be aligned with the pin bores 32 of each body shown in FIGS. 10 and 11 when either one of the plugs is assembled therein. The keyway in the plugs of FIGS. 10 and 11 may be the same or different in accordance with the present invention and the plugs in FIGS. 10 and 11 whether they have the same keyway or not may each be used to release the pins in both of the exterior bodies shown in FIGS. 10 and 11 by using an appropriate key that fits the particular keyway in the plug.

In order to accommodate different keys having the bitting at various distances away from the key shoulder 118–122, the length of the head of the plugs 26 projecting out away from shoulders 30 are different and the distance P is less than the distance P' as shown in FIGS. 10 and 11 respectively. Key 112 is a different key from 114 since the distance between bitting 116 and key shoulder 118 is less than the distance between bitting 120 and key shoulder 122 of key 114. The distance F plus P equals K in FIG. 10 and the distance F' plus P' equals K' in FIG. 11. When key 112 is inserted in the plug of FIG. 10 with the shoulder 118 against the face of the plug, the bitting 116 will be aligned with the plug pin bore 34 and bitting 120 will also be aligned with plug pin bore 34 in FIG. 11 when shoulder 122 of key 114 is against the face of the plug.

For ease of description, only one pin bore 32 and 34 respectively in the exterior body 20 and plug 26 are shown in FIGS. 8 through 11. In accordance with the general standard procedure in the art, the successive pin bores in the exterior body and plug of most manufacturers are spaced an equal distance apart along the length of the exterior body and plug so that the distance G between the centerlines of the successive bores are all equal (FIG. 1). It will also be understood that the keys 112 and 114 will be provided with successive bittings along the length of the key which bittings will be aligned with the successive pin bores 34 when the key is inserted into the keyway 123 (FIG. 3) of plug 26. The depth of each bitting is such that pins 38 in the plug will be lifted up the proper distance to raise the upper pins 36 in the exterior body just enough to clear the plug which is thereupon free to rotate and rotate the cam means which in cooperation with the lock mechanism retracts the latch or bolt in known manner.

FIGS. 3*a* and 3*b* illustrate plugs 26 of the present invention provided with different keyway configurations 124 and 125 respectively. However, as brought out above, the plugs of the present invention are freely interchangeable and operable in any exterior body regardless of whether the plugs have the same or different keyways. This is done by maintaining the distance F and F' constant in the body and plug and by changing the distance P–P' of the face of the plug from the reference shoulder 30 to accommodate different spacing of key bitting from the key shoulders 118–122.

FIG. 15 illustrates a conventional cylindrical lockset 126 which is mounted in a cylindrical hole in a door (not shown) by inserting the cylindrical part 128 of the lockset through the hole in the door in known manner. The external configuration of the exterior body 20 and the cam means shown in the drawings may be changed in known manner to accommodate the particular conventional cylindrical lockset at hand but the principle of the present invention as illustrated in FIGS. 10 and 11 will be utilized in the construction of the cylinder assembly even though the external configuration of the exterior body 20 may not be cylindrical.

A typical cylinder assembly 129 that may be employed in known manner to retract the latch 131 of lockset 126 is illustrated in FIGS. 16 and 17. As there shown, the exterior body 130 has a lower cylindrical portion 132 and a top portion 134 which is generally rectangular. The cylindrical plug 136 fits into a cylindrical bore in the lower portion 132 of body 130. The plug 136 is provided with a fixed annular collar 138 that bears against one end 139 of the lower cylindrical portion 132 of exterior body 130. The second end portion of plug 136 projects a small distance out beyond the second end of the exterior body 130 and is provided with external threads 139 that mate with the internal threads (not shown) of collar 140. When threaded into place on plug 136, collar 140 retains the plug in body 130. The collar also constitutes part of the cam means that activate the latch or bolt such as latch 131 of lockset 126. The cylinder assembly of FIGS. 16 and 17 may be used to activate dead bolts, padlocks, patio door locking mechanisms etc. by using suitable conventional cam means for the lock at hand.

The particular cam means illustrated in the drawings comprise a tail cam 142 rigidly affixed to a circular base 144 having a peripheral portion cut away to form shoulder stops 146 and 148. When assembled, the circular base 144 is positioned against the threaded end portion of plug 136 with the tail 142 projecting out from the end of the plug. Tail 142 projects through opening 150 in washer 152 and through opening 154 in collar 140 as illustrated in the expanded view of FIG. 18. The base 144 of tail cam 142 is preferably locked to the plug by means of a round pin 156 which is positioned in one of the blind bores 158 of plug 136 to project out through the cut out portion adjacent one of the shoulder stops 146–148 of base 144 and through the opening 160 in washer 152 and into one of the cutouts 162 in the rim of collar 140 when the collar is threaded home on the end of plug 136. A light spring (not shown) in the bottom of bore 158 maintains pin 156 in the cutout 162 of the collar. The collar and tail cam turn with the plug. The collar may be removed by depressing the pin to release it from the cutout 162 in the rim of the collar. The tail cam 142–144 is rotated to bring one of the shoulder stops 146–149 against pin 156 and then the tail is mounted in a conventional locking mechanism. As a result, when the key in plug 136 is given a one half turn to rotate the plug and tail cam to release a dead bolt for example, the key may be turned one half turn in the opposite direction without rotating the tail cam so that the key can be withdrawn from the keyway without again locking the bolt. If the bolt is released by shoulder stop 146, releasing the bolt and removing the key will bring the other shoulder 148 against pin 156 and the reverse action is used for locking the bolt and with-drawing the key from the keyway of the plug. The foregoing override feature of cam 142–144 while preferred need not be employed in the cam means of the cylinder assembly.

The pin bores (not shown) in the exterior body 130 are positioned in the rectangular top portion 134 and in the cylindrical plug 136 in exactly the same way as described herein for the cylinder assembly of FIGS. 1, 10 and 11. In the case of the cylinder assembly of FIGS. 16 and 17, the first pin bore in the exterior body portion 134 and plug are maintained at a constant distance "F" from the end 139 of the lower cylindrical portion 132 of the body. Keys having the first bitting located at different distances away from shoulders 118 and 122 (FIGS. 10 and 11) are accommodated by changing the distance P–P′ as by increasing or decreasing the width of collar 138 on the plug to maintain a constant distance K as described in connection with FIGS. 1, 10 and 11.

Figure 19A:
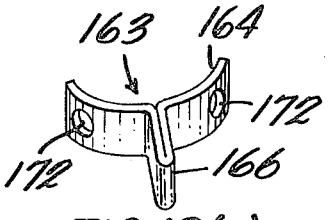

Another form of cam means for the cylinder assembly of the present invention is illustrated in FIGS. 19 and 19*a*. As there shown, the cam means 163 comprises a semicircular strap or base 164 having a cam member 166 rigidly affixed thereto. Cam 163 is readily mounted in the cylinder assembly 129 of FIGS. 16 and 17 by cutting a slot 168 in the lower cylindrical portion 132 of the exterior body 130. The base 164 of the cam means is rigidly affixed to plug 136 by a pair of screws 170 inserted through holes 172 of cam 163 and threaded into a pair of corresponding threaded bores (not shown) in plug 136. Slot 168 is large enough to accommodate the desired rotation of the cam base for releasing and securing a lock in a conventional locking mechanism. The opposite ends of the slot 168 serve as stops to restrict rotation of base 164 within slot 168. This form of cam means is conventionally employed for activating the lock of letter boxes and other simple lock boxes. If desired, the cam means of FIGS. 18 and 19 can be employed with the cylinder assembly of FIG. 1 in obvious manner.

FIG. 20 illustrates use of cylinder assembly 129 for activating the locking mechanism in a patio door. The patio door locking mechanism 174 is conventionally mounted in a sliding patio door in known manner to lock the closed door. Cylinder assembly 129 is most conveniently mounted in the locking assembly by positioning the exterior body 130 against the inside of face plate 176 with collar 138 projecting through an opening in the face plate provided for this purpose. The cylinder assembly is secured in place by means of two stops 178 rigidly affixed to face plate 176 to bear against opposite sides of the exterior of the rectangular upper portion 134 of the exterior body 130. A retaining washer 180 positioned in notch 182 in the rectangular portion of the exterior body secures the cylinder assembly 129 against the surface of face plate 176. The retaining washer is secured in place by screw 184 which passes through the washer and is threaded into the bore of a retaining post 186 rigidly affixed to the face plate. Tail cam 142 passes through the locking mechanism 174 to activate the latch in known manner and the tail cam projects into the camming means 188 attached to the inside handle 190 carried by the interior face plate 192 so that rotation of handle 190 will rotate the cam tail 142 to release the latch from inside. The assembly is mounted on the patio door by inserting the locking mechanism in a slot in the door and by pulling the face plates 176 and 192 tightly against opposite sides of the door by threading the retaining screws 194 into the blind bore of the retaining posts 196. The door is provided the necessary openings to accommodate the various parts so that the face plates can be drawn in flush against opposite sides of the door.

It will be understood that the terms cylinder assembly, cylinder assemblies and cylinder and cylinders used in the specification and claims are intended to mean the internal construction wherein a cylindrical plug is employed in a cylindrical bore with aligned pin bores even though the exterior configuration of the exterior body is not cylindrical.

The cylinders and plugs of the present invention provide a lock system of cylinder assemblies that is of particular utility for commercial or institutional establishments in which a plurality of locking mechanisms of different manufacturers are employed. The interchangeable plugs and bodies of the present invention are of particular advantage for changing the key of a lock by inserting a different plug into an existing exterior body installed in a door and once the system has been installed it greatly reduces the inventory stock of exterior bodies which have to be maintained as compared to prior art cylinder assemblies in which the plugs are not interchangeable. The system also has the advantage of providing a single cylinder assembly that will operate both mortise and rim type locking mechanisms and this eliminates the need for maintaining a separate inventory of different cylinder assemblies for each type of locking mechanism.

Merchandising of the cylinder assemblies of the present invention is greatly simplified since the system may be sold in kits containing a plurality of exterior bodies and plugs and the plugs may have an assortment of different keyways as illustrated in FIGS. 3, 3*a* and 3*b*. Moreover, the plugs may have different "K" values (FIGS. 10 and 11) and the number of plugs may exceed the number of exterior bodies to expedite changing keys without the need of changing the exterior body of the cylinder assemblies which reduces the cost as compared to prior art cylinder assemblies. The kits will usually contain appropriate keys, mounting plates, tails and washers and cam plates for mortise and rim type locking mechanisms and for cylinder assemblies for cylindrical locksets, patio doors, dead bolts, letter boxes etc. Once the system of the present invention is installed, the kits need only contain replacement plugs and keys for use with the exterior bodies of the present invention that have been installed in a building such as a hotel.

The process of manufacturing the cylinder assemblies of the present invention using conventional blanks is carried out with conventional apparatus, it being only necessary to operate the apparatus with respect to a single reference so that it will form the pin bores in a plurality of exterior body blanks and in a plurality of plug blanks the same distance away from the reference so that the pin bores in all of the plugs will align with the pin bores in a plurality of exterior bodies when a plug is assembled therein. Most conveniently, the reference may constitute either one or both of the mating shoulders 28 and 30 of exterior body 20 and plug 26 respectively and the reference may constitute the end 139 of the exterior body 130 of the cylinder assembly 129 of FIGS. 16 and 17. In accordance with the present invention, the centerline of the first pin bore in the exterior bodies and plugs is located the same distance away from the reference so that F equals F′ as illustrated in FIGS. 10 and 11. In general, the standard procedure in the art is followed by locating the centerline of the second and each successive pin bore at the same distance G between adjacent pin bores in the exterior bodies and plugs. The distance F at which the first pin bore is located with respect to the reference may be equal to G or the distances F and G may be different.

The machining of the plug blank length and keyway is carried out in known conventional manner except that in accordance with the present invention the plug is formed in conventional apparatus with the keyway face of the plug located at different distances P and P' (FIGS. 10 and 11) from the reference in order to accommodate different key bitting and different "K" values for different keyway configurations. The plug blanks are formed in known manner with different length of heads for this purpose. In preferred manufacture, the apparatus is properly indexed to automatically locate the pin bores in specified location and to automatically locate the keyway face of the plug at the selected but different distances away from the first pin bore in accordance with the present invention. It is of advantage to make up an inventory stock of plugs having pin bores with a blank keyway and with the plug head length long enough to accommodate all of the different "K" values. All of the inventory stock of plugs are uniformly made and thereafter plugs drawn from inventory stock are provided with the desired keyway configuration and the plug heads are machined to provide the desired P–P' length.

It will be understood that it is intended to cover all changes and modifications of the present invention which do not constitute a departure from the spirit and scope of the embodiments of the invention herein chosen for the purpose of illustration.

What is claimed is:

1. A lock system of cylinder assemblies for operating a plurality of locking mechanisms in a commercial or institutional establishment which system of cylinder assemblies comprises:

(a) a plurality of exterior body members each having a main cylindrical bore therein for a rotatable plug, (b) a plurality of plugs for said members said plugs when assemblied in said cylindrical bores providing an exposed keyway face at one end portion thereof, (c) said plurality of exterior body members having one or more pin bores therein and said plurality of plugs having one or more pin bores therein which said pin bores are aligned when said plugs are assembled in the cylindrical bores of said members, and (d) said one or more pin bores in each said plurality of members and plugs being located a constant distance away from a reference point of said cylinder assembly and the exposed keyway face on said plurality of plugs when assembled in said cylindrical bores being positioned at different distances away from said reference point whereby the exterior body members and plugs are interchangeable and the one or more pin bores in any one plug of the plurality will be aligned with the one or more pin bores in any one of the plurality of members when the plug is assembled therein.

2. The system of cylinder assemblies of claim 1 in which the main bore of each of a plurality of exterior body members is stepped adjacent its mouth to form a shoulder therein and in which each of a plurality of plugs has a corresponding shoulder adjacent the keyway face thereof so that the two shoulders mate when the plug is assembled in the member and in which the mating shoulders constitute said reference point.

3. The system of cylinder assemblies of claim 1 in which said plurality of plugs each have different keyways to accommodate keys with different bitting locations.

4. The system of cylindrical assemblies of claim 1 in which a plurality of exterior body members each have an external shoulder at one end portion thereof, a longitudinal slot in opposite exterior sides thereof, and threaded holes in the second end portion of each said member and in which each of a plurality of plugs have cam means at the second end portion thereof for mounting in a mortise or rim type locking mechanism and whereby each of said plurality of cylinder assemblies may be mounted to operate a mortise or rim type lock.

5. A kit for locks that utilize cylinder assemblies for activating the latch or bolt of a locking mechanism comprising:

(a) a plurality of exterior body members each having a main cylindrical bore therein for a rotatable plug, (b) one or more plugs having a keyway in one end portion thereof, (c) one or more pin bores in each of said plurality of members and in said one or more plugs, and (d) said one or more pin bores in said plurality of members and in said one or more plugs being located a set constant distance away from a reference point in said assembly and the exposed keyway face on said one or more plugs when assembled in said cylindrical bores being positioned at different distances away from said reference point to accommodate keys with different bitting locations whereby the one or more plugs may be interchangeably used in said plurality of body members with said one or more pin bores in said members aligned with the one or more pin bores in said one or more plugs when the plug is assembled in the main bore of said exterior body members.

6. A kit for locks that utilize cylinder assemblies for activating the latch or bolt of a locking mechanism comprising:

(a) one or more exterior body members having a main cylindrical bore for a rotatable plug therein, (b) a plurality of plugs each having a keyway in one end portion thereof, (c) one or more pin bores in each of said one or more members and plurality of plugs, and (d) said one or more pin bores in said one or more members and in said plurality of plugs being located a set constant distance from a reference point in said assembly and the exposed keyway face on said plurality of plugs when assemblied in said cylindrical bores being positioned at different distances from said reference point to accommodate keys with different bitting locations whereby each of said plurality of plugs may be interchangeably used in said one or more members with said one or more pin bores in said plugs aligned with said one or more pin bores in said one or more members when the plug is assembled in the main bore of said exterior body members.

7. The kit of claim 5 or alternatively claim 6 in which the main bore of the one or more exterior body members is stepped adjacent its mouth to provide a shoulder therein and in which the one or more plugs have a shoulder adjacent the keyway end of the plug which mates with said shoulder in the main bore and said mating shoulders constitute the said reference point.

8. The kit of claim 5 or alternatively claim 6 in which the plugs have keyways of different configuration.

9. The kit of claim 5 or alternatively 6 in which the one or more exterior body members each have an exterior shoulder projecting out from one end portion thereof and each member has a longitudinal slot on opposite sides thereof and threaded holes in the second end portion of each member and in which the one or more plugs each have cam means at the second end portion thereof for a mortise or rim lock whereby said slot may be used to receive a set screw for mounting the cylinder assembly for operation of a mortise type lock and said threaded holes and member shoulder may be used for mounting the cylinder assembly for operating a rim type lock.

10. The process of manufacturing a plurality of cylinder lock assemblies of the type wherein each comprise an exterior body member having a main cylindrical bore with a rotatable plug therein having an exposed keyway face at one end portion of said plugs with apparatus operated to perform the processing steps of:

(a) forming one or more pin bores in said exterior body members, (b) forming one or more pin bores in said plugs that will be in alignment with said one or more pin bores in said members when the plugs are in place therein, and (c) locating said one or more pin bores in the members and plugs a constant distance away from a reference point whereby the members and plugs are interchangeable, and (d) locating said exposed keyway face of the plug at such a distance away from said reference that the distance of the keyway face from said reference may be shortened by subsequent milling to accommodate keys with different bitting locations.

11. The process of claim 10 which includes the step of forming said plugs with said keyway face located at different distances away from said reference point to accommodate keys with different bitting locations.

12. The process of claim 10 which includes the step of forming a stepped bore in said exterior body members to form a shoulder therein which constitute said reference point.

13. The process of claim 12 which includes the step of forming a shoulder on the keyway end portion of said plugs that mates with said shoulder in the exterior body member when the plug is assembled in said stepped bore.

14. The process of manufacturing a cylinder assembly for a mortise or rim type lock of the type comprising an exterior body member with a rotatable plug therein having an exposed keyway face at one end portion thereof with apparatus operated to perform the processing steps of:

(a) forming an exterior annular shoulder projecting out from one end of said exterior body member, (b) forming longitudinal slot means on opposite exterior sides of said member for receiving a mortise lockset screw, (c) forming threaded holes in the second end portion of said member for receiving mounting screws for a rim lock, (d) forming means on the second end portion of said plugs for mounting cam means for activating the bolt or latch of a mortise or rim type lock, and (e) forming the exposed keyway face on said plug to project out from said exterior body member when the plug is assembled therein at such a distance that the said distance may be shortened by subsequent milling to accommodate keys with different bitting locations.

15. The process of manufacturing a plurality of cylinder lock assemblies of the type comprising an exterior body member and a rotatable plug therein having an exposed keyway face at one end portion thereof with apparatus operated to perform the processing steps of:

(a) forming a shoulder that projects out from one end portion of the exterior body member, (b) forming at least one longitudinal slot in the exterior of said body members for receiving a mortise lockset screw, (c) forming threaded holes in the second end portion of said body members for receiving mounting screws for a rim lock, (d) forming one or more pin bores in said body members, (e) forming one or more pin bores in said plugs that will align with said one or more pin bores of the body members when the plugs are in place therein, (f) locating said one or more pin bores in the body members and plugs a constant distance away from a reference point whereby the body members and plugs are interchangeable, (g) forming said keyway face on said plugs at different distances from said exterior body member to accommodate keys with different bitting, and (h) forming mounting means on the second end portion of said plugs for affixing cam means for activating the bolt or latch of a mortise or rim lock.

16. The process of claim 15 which includes the steps of forming a stepped bore in said exterior body members to form a shoulder therein which constitutes said reference point and forming a shoulder on the keyway end of said plugs that mates with said shoulder in the body member when the plug is assembled in said stepped bore.

17. The process of manufacturing a plurality of plugs having a keyway face at one end thereof for a plurality of cylinder assembly exterior body members having pin bores therein with apparatus operated to perform the processing step of forming one or more pin bores in each of said plurality of plugs which pin bores in the plug will align with the pin bores in a plurality of said members when the plug is assembled therein and forming said plugs with a keyway face located different distances away from said exterior body members to accommodate keys with different bitting locations.

18. A kit for locks that utilize a plurality of exterior body members having pin bores therein which kit comprises a plurality of plugs each of which plurality of plugs have pin bores therein that will align with the pin bores in a plurality of said members when the plug is assembled therein and each of said plurality of plugs having a keyway face located different distances away from said exterior body member to accommodate keys with different bitting locations.

* * * * *